US008123045B2

(12) United States Patent
White et al.

(10) Patent No.: US 8,123,045 B2
(45) Date of Patent: Feb. 28, 2012

(54) APPARATUS FOR SEPARATING POPPED CORN FROM UN-POPPED KERNELS

(76) Inventors: Jeffrey M. White, Victor, MT (US); Charles C. Hiigel, Victor, MT (US)

( * ) Notice: Subject to any disclaimer, the term of this patent is extended or adjusted under 35 U.S.C. 154(b) by 0 days.

(21) Appl. No.: 12/704,702

(22) Filed: Feb. 12, 2010

(65) Prior Publication Data

US 2010/0206781 A1 Aug. 19, 2010

Related U.S. Application Data

(60) Provisional application No. 61/153,085, filed on Feb. 17, 2009.

(51) Int. Cl.
*B07B 13/00* (2006.01)

(52) U.S. Cl. ..... 209/680; 209/235; 209/274; 209/417; 99/323.5

(58) Field of Classification Search ..... 209/235, 209/274, 417, 680; 273/348; 99/323.5
See application file for complete search history.

(56) References Cited

U.S. PATENT DOCUMENTS 1,330,868 A 2/1920 Harrison (Continued)

*Primary Examiner* — Terrell Matthews
(74) *Attorney, Agent, or Firm* — Kunzler Needham Massey & Thorpe

(57) ABSTRACT

An apparatus is disclosed for separating popped corn from un-popped kernels. The apparatus includes a popped corn container that holds popped corn and a kernel separator located on a side of the popped corn container. The kernel separator includes a kernel separator screen with a plurality of holes, where a hole in the plurality of holes is larger than an un-popped kernel and smaller than a fully popped corn. The kernel separator also includes a reentry impedance means for impeding an un-popped kernel from entering the popped corn container through the kernel separator. The apparatus also includes a kernel container positioned outside the popped corn container and adjacent to the kernel separator such that the kernel container stores the un-popped kernel after the un-popped kernel has passed through the kernel separator. The apparatus may further include a cover container.

19 Claims, 6 Drawing Sheets

U.S. PATENT DOCUMENTS 3,170,875 A * 2/1965 Swett ..... 210/465
3,930,996 A 1/1976 Day et al.
3,961,091 A 6/1976 Caccavale et al.
4,096,281 A 6/1978 Young et al.
4,445,427 A 5/1984 Kiczek
4,457,435 A 7/1984 Truman
4,496,816 A 1/1985 McNamara
4,532,397 A 7/1985 McClelland
4,563,561 A 1/1986 Vaeth et al.
4,649,263 A 3/1987 Goodlaxson
4,763,568 A 8/1988 Kiczek
4,823,683 A 4/1989 Meisner
4,881,457 A 11/1989 Lyga et al.
4,902,520 A 2/1990 Dysarz
4,942,277 A * 7/1990 Narberes ..... 219/734
4,963,374 A 10/1990 Brandel et al.
5,071,662 A 12/1991 Dysarz
5,163,357 A 11/1992 Felknor et al.
5,215,196 A * 6/1993 Valls ..... 209/417
5,314,075 A 5/1994 Nguyen et al.
5,332,102 A * 7/1994 Sennett et al. ..... 209/417
5,368,170 A * 11/1994 Leis ..... 209/680
5,925,393 A 7/1999 Stein et al.
5,928,550 A 7/1999 Weiss
6,000,318 A 12/1999 Weiss et al.
D468,168 S * 1/2003 Gruenberg, Sr. ..... D7/667
D613,131 S * 4/2010 Chen et al. ..... D7/667
2005/0205487 A1 * 9/2005 Rogers ..... 210/464
2006/0042472 A1 3/2006 Shore
2008/0211189 A1 * 9/2008 Williams et al. ..... 273/348

* cited by examiner

APPARATUS FOR SEPARATING POPPED CORN FROM UN-POPPED KERNELS

CROSS-REFERENCES TO RELATED APPLICATIONS

This application claims priority to U.S. Provisional Patent Application No. 61/153,085 entitled "Unpopped Kernel Separation and Flavor Mixing Apparatus" and filed on Feb. 17, 2009 for Jeffrey M. White and Charles C. Hiigel, which is incorporated herein by reference.

FIELD OF THE INVENTION

This invention relates to an apparatus for popcorn preparation and more particularly relates to an apparatus for separating un-popped corn kernels from popped corn kernels

BACKGROUND

Description of the Related Art

Many people enjoy popcorn because it is healthy, flavorful, and easy to make. However, during popping, a few popcorn kernels will fail to pop, leaving behind rock hard objects hidden amongst the delicious, inviting treat. Because of its hard nature and small shape, the un-popped kernel presents several health risks to a person enjoying the fluffy snack. Hereinafter an "un-popped" kernel refers to a kernel of popcorn that is in an original, unexpanded state or in a state of partial expansion such that the un-popped kernel is hard and poses a threat to a person biting or eating the un-popped kernel. A popcorn kernel may be un-popped before a popping process or after a popping process. An un-popped kernel that remains un-popped after being exposed to a popping process is commonly referred to as an "old maid."

Many people, while consuming the enjoyable snack, have accidently bitten into an un-popped kernel. Because the kernels are hard, biting into a kernel is uncomfortable and can break a tooth. Fixing a broken tooth is expensive and may be cost prohibitive for some people. When a broken tooth remains unfixed it can cause several health problems that range from headaches and tooth decay, to sepsis and death. Un-popped kernels also present a great risk to toddlers and infants. The kernels can easily lodge in a child's throat, choking the child, which also can lead to death.

SUMMARY

From the foregoing discussion, it should be apparent that a need exists for an apparatus that separates popped corn from un-popped kernels. Beneficially, such an apparatus would allow a user to effortlessly separate kernels from popped corn during popcorn preparation.

The present invention has been developed in response to the present state of the art, and in particular, in response to the problems and needs in the art that have not yet been fully solved by currently available devices for separating popped corn from un-popped kernels. Accordingly, the present invention has been developed to provide an apparatus for separating popped corn from un-popped kernels that overcome many or all of the above-discussed shortcomings in the art.

The apparatus, in one embodiment, separates popped corn from un-popped kernels. The apparatus may have a popped corn container that holds popped corn and a kernel separator located on a side of the popped corn container. Further, the kernel separator may have a kernel separator screen with a plurality of holes, where a hole in the plurality of holes is larger than an un-popped kernel and smaller than a fully popped corn. The kernel separator also may have a reentry impedance means that impedes an un-popped kernel from entering the popped corn container through the kernel separator. The apparatus may include a kernel container positioned outside the popped corn container and adjacent to the kernel separator such that the kernel container stores the un-popped kernel after the un-popped kernel has passed through the kernel separator.

In one embodiment, the sides of the popped corn container slope toward the kernel separator. In another embodiment, the popped corn container is a bowl and the kernel separator is located at the bottom of the bowl. In another embodiment, the reentry impedance means comprises lateral cross members that bound each hole in the plurality of holes in the kernel separator screen. The lateral cross members may have a triangular cross section, where a base of the triangular cross section is on a kernel face of the kernel separator and the kernel face faces the kernel container, and where a vertex of the triangular cross section is on a popped corn face of the kernel separator and the popped corn face faces the popped corn in the popped corn container. In another embodiment, the lateral cross members are oriented perpendicularly to one another.

In one embodiment, the reentry impedance means comprises a kernel retention means for maintaining the kernels in the kernel container. In a further embodiment, the kernel retention means includes a kernel restraining structure positioned between the kernel separator screen and a bottom of the kernel container such that kernels at the bottom of the kernel container are impeded from re-entry into the popped corn container when agitated. The kernel restraining structure is positioned such that a space between the kernel separator screen and the kernel restraining structure is wider than a kernel. In another embodiment, the kernel restraining structure is positioned to slope away from the kernel separator screen. In yet another embodiment, the kernel restraining structure includes an umbrella shape, such that a top point of the kernel restraining structure faces the kernel separator screen and the kernel restraining structure slopes away from the top point in all directions.

In another embodiment, the sides of the kernel container slope towards a bottom of the kernel container and the bottom of the kernel container includes an area that matches or is less than an area of the kernel restraining structure. In another embodiment, the kernel restraining structure has an area that matches or exceeds an area of the kernel separator screen. In another embodiment, the kernel container is a bowl and the popped corn container nests inside the kernel container. In yet another embodiment, the popped corn container further comprises a grippable area for removing the popped corn container from inside of the kernel container.

In one embodiment, the apparatus includes a graspable handle attached to the kernel container. In another embodiment, the apparatus includes a cover container. In a further embodiment, the cover container includes a popcorn cooking surface. In yet another embodiment, the cover container may be used as a popcorn serving bowl.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
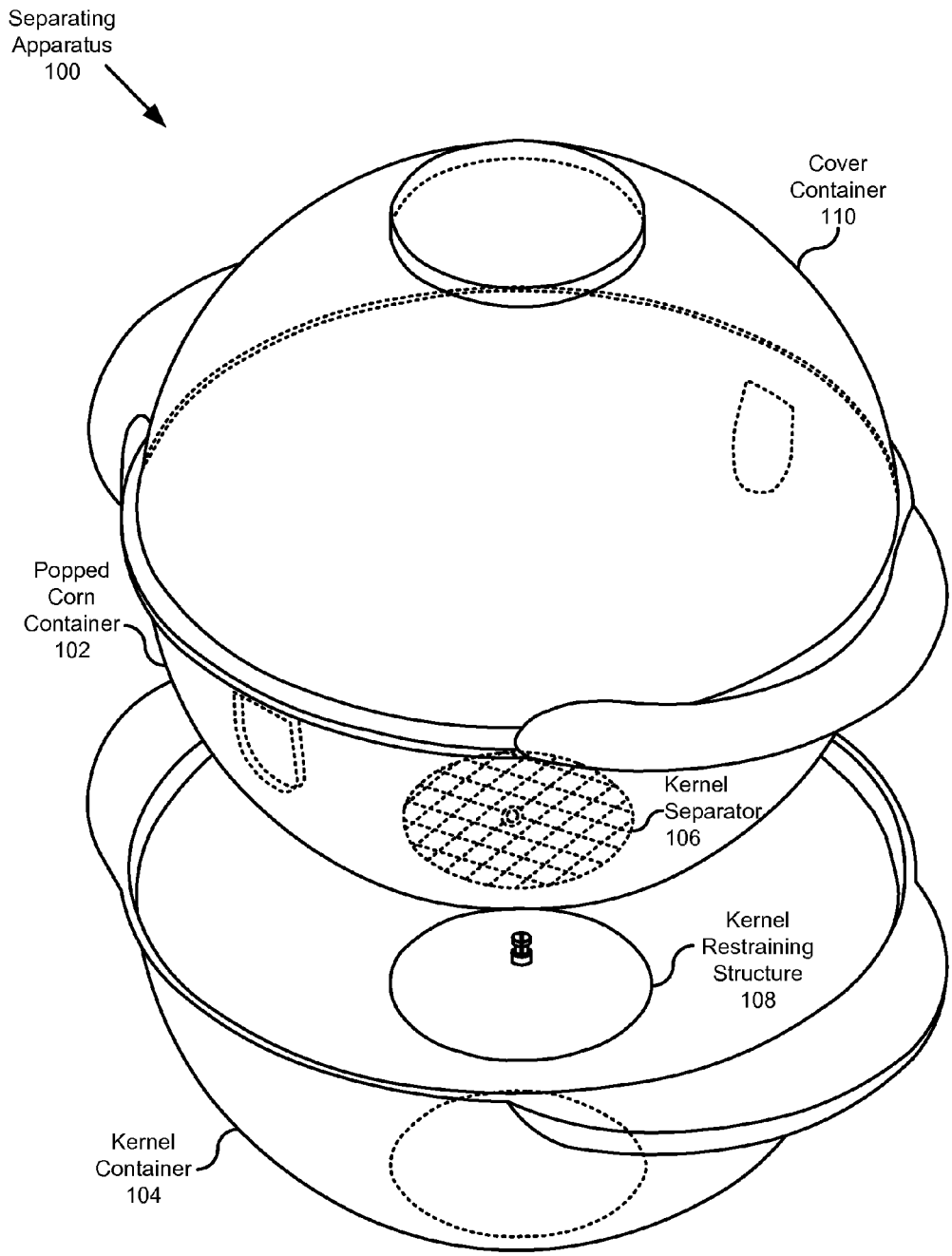
FIG. 1 is a perspective view illustrating one embodiment of an apparatus for separating popped corn from un-popped kernels in accordance with the present invention.

FIG. 1 depicts an exploded view of one embodiment of the separating apparatus 100 for separating popped corn from un-popped kernels according to at least one embodiment. The separating apparatus 100 may comprise a popped corn container 102, a kernel container 104, a kernel separator 106, a kernel restraining structure 108, and a cover container 110. The term "kernel," as used herein, refers to a kernel of popcorn that failed to pop during the popping process. The phrase "popped corn," as used herein, refers to a kernel of popcorn that popped during the popping process.

In certain embodiments, after popcorn has passed through the popping process, the mixture of popped corn and kernels is placed in the popped corn container 102. The popped corn container 102 includes a container that, when agitated, will allow kernels to exit the popped corn container 102 through the kernel separator 106 located on the bottom of the popped corn container 102 while keeping the popped corn inside the popped corn container 102. For example, the popped corn container 102 may comprise a bowl with a kernel separator 106 at the bottom of the bowl, such that, when the separating apparatus 100 is agitated, the kernels move to the bottom of the bowl and through the kernel separator 106.

In at least one embodiment, the kernel separator 106 may include a screen that allows kernels to pass through the screen but prevents fully popped corns or nearly fully popped corns from passing through the screen. The screen may have several holes that are larger than an un-popped kernel but smaller than a fully popped corn. For example, with the kernel separator 106 located at the bottom of the popped corn container 102, a kernel may pass through the kernel separator 106 while a popped corn may stay in the popped corn container 102.

In a number of embodiments, after the kernel has passed through the kernel separator 106, the kernel will enter the kernel container 104. The kernel container 104 may be positioned outside the popped corn container 102 and adjacent to the kernel separator 106. The kernel container 104 may store kernels that have passed through the kernel separator 106 so that the kernels can be thrown away after they have been removed from the popped corn container 102. The kernel container 104 is in a position such that kernels that pass through the kernel separator 106 enter the kernel container 104. For example, the kernel container 104 may store the kernels that have passed through the kernel separator 106. After a user finishes shaking the popped corn container 102, the user may remove the kernel container 104 from its location under the kernel separator 106 and remove the kernels from the kernel container 104.

In certain embodiments, after the kernels pass through the kernel separator 106, the kernels may attempt to reenter the popped corn container 102 through the kernel separator 106. To impede kernels from entering the popped corn container 102 through the kernel separator 106, the separating apparatus 100 may also have a reentry impedance means. The reentry impedance means includes the structure of the kernel separator 106 and a kernel retention means that impedes a kernel from entering the popped corn container 102 through the kernel separator 106. The kernel retention means may include the kernel restraining structure 108. For example, the kernel restraining structure 108 may capture kernels, preventing the kernels from contacting the kernel separator 106 during agitation.

In a further embodiment, a cover container 110 may be placed on top of the popped corn container 102 to prevent popcorn from spilling out of the popped corn container 102 during agitation. For example, the cover container 110 may include a bowl that, when placed on top of the popped corn container 102, keeps the popped corn within the popped corn container 102 when a user shakes the separating apparatus 100 to remove kernels from the popped corn container 102. The separating apparatus 100 may help a user separate kernels from the popped corns so that a person can safely enjoy the popcorn.

In certain embodiments, the separating apparatus 100 may appear spherical. For example, the cover container 110 and the kernel container 104 may include two bowls that are stacked onto each other to form a spherical shape. In at least one embodiment, the separating apparatus 100 may be designed in the shape of a sporting ball and/or decorated with corresponding coloring. For example, the separating apparatus 100 may be in the shape of a baseball, a football, a hockey puck, a soccer ball, a basketball, a tennis ball, and the like. Further, the separating apparatus 100 may be constructed from metal, glass, plastic, and the like.

Figure 2A:
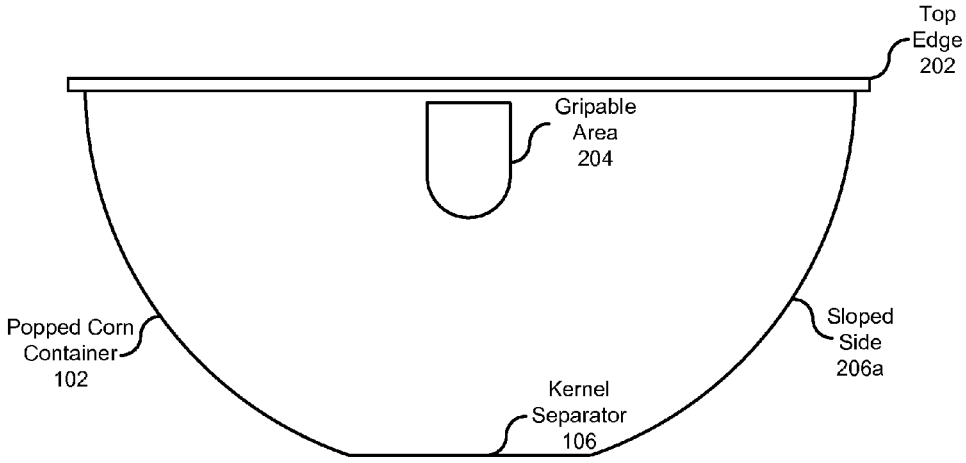
FIG. 2A is a side view illustrating a bowl shaped popped corn container in accordance with the present invention.

FIG. 2A shows a side view of the popped corn container 102 according to at least one embodiment. For example, the popped corn container 102 may include the kernel separator 106, a top edge 202, a grippable area 204, and a sloped side 206*a*. As illustrated, the popped corn container 102 may include a bowl shape, however, the popped corn container 102 may be a shape that stores popped corns and allows kernels to fall through the kernel separator 106 when the popped corn container 102 is shaken. For example, the popped corn container 102 may have the shape of a cube, a truncated cone, a cylinder, a sports ball, a decorative object, and the like.

In certain embodiments, the popped corn container 102 nests inside the kernel container 104 in FIG. 1. The popped corn container 102 may include a top edge 202 that may include a lip and that may abut against the top surface of the kernel container 104. The top edge 202 may prevent the popped corn container 102 from sliding too far into the kernel container 104, such that the top edge 202 may prevent the popped corn container 102 from becoming difficult to remove from the kernel container 104. Also, if the popped corn container 102 slides too far into the kernel container 104, the bottom of the popped corn container 102 may become too close to the bottom of the kernel container 104, decreasing the space available for kernels after they pass through the kernel separator 106, negatively impacting the efficiency of kernel separation. The top edge 202 or general shape of the popped corn container 102 may facilitate the ease of using the popped corn container 102 by preventing it from sliding too far into the kernel container 104.

In another embodiment, the popped corn container 102 may include a grippable area 204. The grippable area 204 facilitates the removal of the popped corn container 102 from within the inside of the kernel container 104 in FIG. 1. The grippable area 204 may include an indentation, a hole, a small handle, a corrugated surface, a non-slip surface, and the like. For example, the kernel container 104 may contain a nested popped corn container 102. Further, the popped corn container 102 may include two grippable areas 204 on opposing sides of the popped corn container 102. To remove the popped corn container 102 from the kernel container 104, a user may apply pressure to the grippable areas 204 and lift the popped corn container 102 out of the kernel container 104.

In one embodiment, the popped corn container 102 includes a locking mechanism (not shown) that secures the popped corn container 102 to the kernel container 104. The locking mechanism, in one embodiment, includes one or more additional moving parts that secure the popped corn container 102 to the kernel container 104. In another embodiment, the locking mechanism includes a friction mechanism that secures the popped corn container 102 to the kernel container 104 using friction. In another embodiment, the locking mechanism includes a raised portion on either the popped corn container 102 or the kernel container 104 and a corresponding recess on the component without the raised portion such that the popped corn container 102 locks into the kernel container 104 as pressure is applied. In another embodiment, the locking mechanism includes threads for screwing the kernel container 104 to the popped corn container 102. One of skill in the art will recognize other locking mechanisms for securing a popped corn container 102 to a kernel container 104.

In certain embodiments, the popped corn container 102 may include a sloped side 206*a* that slopes toward the kernel separator 106. The sloped side 206*a* may include the side of the popped corn container 102 and connects the top edge 202 to the kernel separator 106. For example, where the popped corn container 102 includes a bowl shape, the sloped side 206*a* may parabolically connect the top edge 202 to the kernel separator 106, where the diameter of the kernel separator 106 is less than the diameter of the top edge 202. Further, the sloped side 206*a* may begin sloping toward the kernel separator 106 at a point between the kernel separator 106 and the top edge 202. For instance, the sloped side 206*a* may have the same diameter as the top edge 202 until a point along the sloped side 206*a* at which point the diameter of the sloped side 206*a* may parabolically decrease until the diameter of the sloped side 206*a* is equal to the diameter of the kernel separator 106. In an alternative embodiment, the kernel separator 106 may have the same diameter as the top edge 202.

Figure 2B:
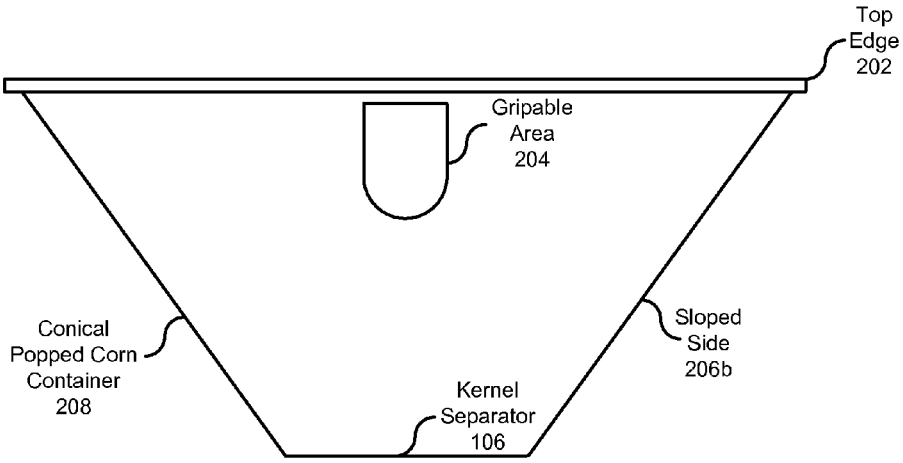
FIG. 2B is a side view illustrating a conical shaped popped corn container in accordance with the present invention.

FIG. 2B shows a side view of a conical popped corn container 208 according to at least one embodiment. As shown, the conical popped corn container 208 may include a sloped side 206*b*, a kernel separator 106, a top edge 202, and a grippable area 204. The sloped sides 206*b* may extend from the top edge 202 to the kernel separator 106. Further, the sloped sides 206*a* may linearly connect the kernel separator 106 to the top edge 202, the conical popped corn container 208 forming a truncated cone. Also, the sloped side 206*b* may begin sloping toward the kernel separator 106 at a point between the kernel separator 106 and the top edge 202. For instance, the sloped side 206*b* may have the same diameter as the top edge 202 until a point along the sloped side 206*b* at which point the diameter of the sloped side 206*b* may linearly decrease until the diameter of the sloped side 206*b* is equal to the diameter of the kernel separator 106. In alternative embodiments, the popped corn container 102 in FIG. 1 may be shaped like a rectangular box, an oval shaped bowl, a cylindrical box, a truncated pyramid, a sports ball (a football or basketball shape), and the like.

In certain embodiments, the base of the popped corn container 102 may include a kernel separator 106. The kernel separator 106 may include a screen that allows kernels to pass through the screen while keeping popped corns inside the popped corn container 102. The kernel separator 106 may be circular, oval, square, triangular, and the like. In at least one embodiment, the kernel separator 106 may be removable from the popped corn container to facilitate cleaning of the kernel separator 106. Further, shaking the popped corn container 102 may cause a kernel to trickle down through the popped corns until it reaches the base of the popped corn container 102. As the kernel separator 106 may be located at the base of the popped corn container 102, as the kernel reaches the base, the kernel may pass through the kernel separator 106.

Figure 3A:
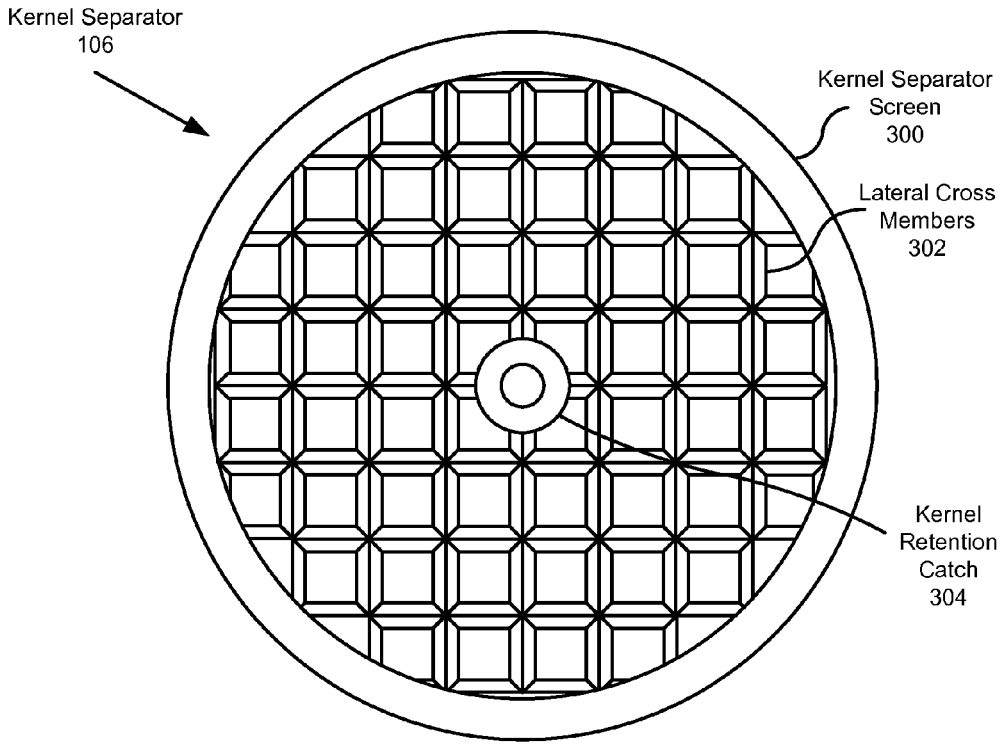
FIG. 3A is a top side view further illustrating a kernel separator screen in accordance with the present invention.

FIG. 3A shows a detailed top view of the kernel separator 106 with a kernel separator screen 300 according to at least one embodiment. The kernel separator screen 300 may include a plurality of lateral cross members 302. In certain embodiments, the lateral cross members 302 may bound holes in the kernel separator screen 300 that allow kernels to pass through the kernel separator screen 300. For example, the lateral cross members 302 may bound square holes, round holes, triangular holes, diamond shaped holes, and the like. Further, the lateral cross members 302 may be oriented perpendicularly to one. The holes in the kernel separator screen 300 may be larger than a kernel but smaller than a fully popped corn.

In a further embodiment, the kernel separator screen 300 may include a kernel retention catch 304. In one embodiment, the kernel retention catch 304 secures a kernel restraining structure to the kernel separator screen 300. For example, the kernel retention catch 304 may include a hole with a specific diameter in the center of the kernel separator screen 300. The hole allows an attaching structure to attach the kernel restraining structure to the kernel separator screen 300. The kernel restraining structure impedes kernels from reentering the popped corn container 102 in FIG. 1 when the user agitates the separating apparatus 100.

Figure 3B:
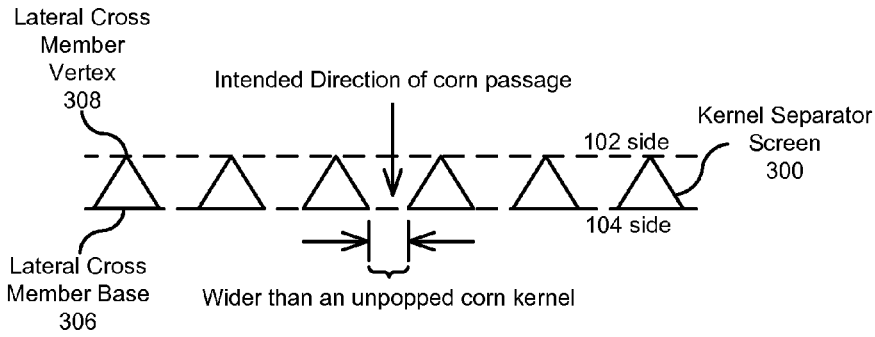
FIG. 3B is a cross sectional view of a kernel separator screen in accordance with the present invention.

FIG. 3B shows a cross section of the lateral cross members 302 in FIG. 3A of the kernel separator screen 300. The structure of the kernel separator screen 300 may function as a reentry impedance means for impeding kernels in the kernel container 104 from reentering the popped corn container 102. In certain embodiments, the lateral cross members 302 may impede kernels from reentering the popped corn container 102 in FIG. 1. For example, the lateral cross members 302 may have a triangular cross section. The triangular cross section of each lateral cross member 302 may have a vertex 308 and a base 306. The vertex 308 of the triangular cross section existing on the side of the kernel separator screen 300 that faces the inside of the popped corn container 102. The base 306 of the triangular cross section existing on the side of the kernel separator screen 300 that faces the outside of the kernel container 104.

In certain embodiments, the triangular cross section of the lateral cross members 302 in FIG. 3A may facilitate the passage of kernels originating in the popped corn container 102 in FIG. 1 through the kernel separator screen 300 and impede kernels originating in the kernel container 104 from passing through the kernel separator screen 300. For example, as the kernel descends through the popped corn container 102 and comes into contact with the kernel separator screen 300, a vertex 308 of a lateral cross member 302 may direct the kernel into a hole in the kernel separator screen 300 where the kernel may pass through the kernel separator screen 300. As the popped corn container 102 and kernel container 104 are shaken, a kernel in the kernel container 104 that comes into contact with the kernel separator screen 300 may bounce off the base 306. The base 306 may impede the passage of the kernel originating in the kernel container 104 from passing through the kernel separator screen 300 and back into the popped corn container 102. The kernel container 104 may store the kernels that passed through the kernel separator screen 300.

Figure 4A:
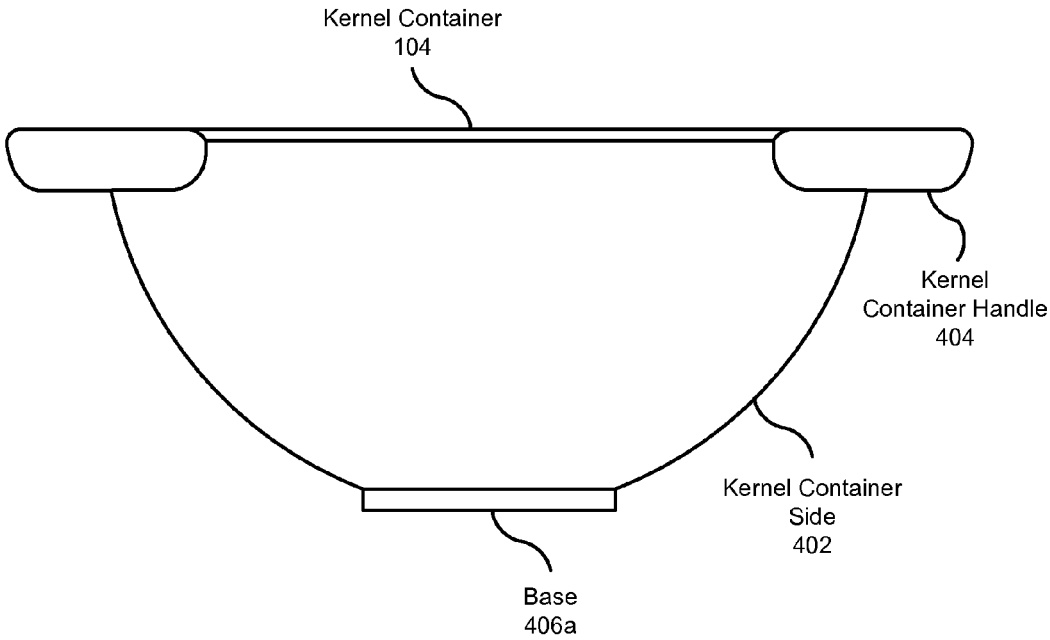
FIG. 4A is a side view of a kernel container in accordance with the present invention.

FIG. 4A illustrates a side view of a kernel container 104 according to one embodiment. The kernel container 104 may include a kernel container handle 404, a kernel container side 402, and a base 406*a*. In certain embodiments, the kernel container 104 may include a bowl that nests around the popped corn container 102 in FIG. 1. In an alternative embodiment, the kernel container 104 may include a container that attaches around the kernel separator 106 in FIG. 1. The kernel container 104 may act as a repository for kernels after they pass through the kernel separator 106 and out of the popped corn container 102. The kernel container 104 may also include a box, a cone, and the like that nest around the popped corn container 102.

In certain embodiments, after a kernel exits the popped corn container 102, the kernel container 104 may direct the kernel to stay in the base 406*a*. The kernel container side 402 may slope toward the base 406*a* such that when the separating apparatus 100 in FIG. 1 is shaken, a kernel that lands on the side will slide into the base. In a further embodiment, the base 406*a* may include a shape that impedes kernel movement during agitation. For example, the base 406*a* may have a conical shape, or ridges that redirect the kernels towards the base 406*a* of the kernel container 104. Further, the base 406*a* may have a diameter that matches or is less than the diameter of the kernel separator 106. Alternatively, the base may also include a mild adhesive that captures kernels during agitation or a cushion that diminishes the effects of shaking the separating apparatus 100 on the kernels in the kernel container 104.

In at least one embodiment, the kernel container 104 may include a kernel container handle 404 that enables a user to easily grasp the separating apparatus 100 in FIG. 1. The handle may attach to the kernel container 104 at opposing sides of the kernel container 104. Alternatively, the kernel container handle 404 may circumscribe the kernel container 104. In a further embodiment, the kernel container 104 may interlock with the popped corn container 102 in FIG. 1, increasing the ease of handling the separating apparatus 100.

Figure 4B:
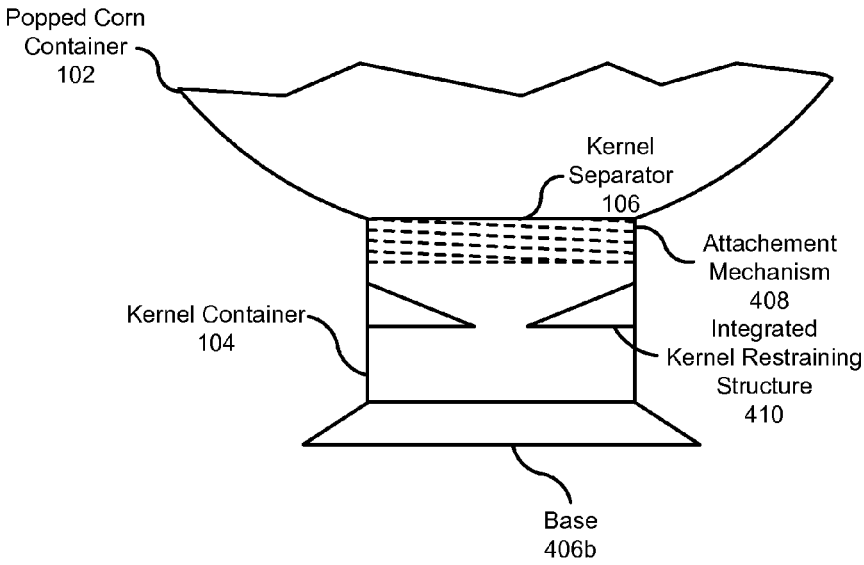
FIG. 4B is a side view of a kernel container attached to a popped corn container in accordance with the present invention.

FIG. 4B shows a side view of an alternative embodiment of the kernel container 104 attached to the popped corn container 102. In certain embodiments, the kernel container 104 may include a base 406*b*, an attachment mechanism 408, and an integrated kernel restraining structure 410. As shown, the kernel container 104 may be a cylindrical shape that may attach to the popped corn container 102. In a further embodiment, the kernel container 104 may be a cone, a bag, a box, and the like where the shape of the kernel container 104 may attach to the popped corn container 102 and store kernels that have passed through the kernel separator 106.

In certain embodiments, an attachment mechanism 408 may secure the kernel container 104 to the popped corn container 102. For example, a user may screw the kernel container 104 to the popped corn container 102. Alternatively, the kernel container 104 may attach to the popped corn container 102 via a twist and lock, a clip, a gasket, a snap on, and the like. In at least one embodiment, the kernel container 104 may be permanently affixed to the popped corn container 102. In such an embodiment, un-popped kernels and other debris may be removed from the kernel container 104 if the kernel separator 106 is removed, via a door in the kernel container 104, or the like.

In another embodiment, a base 406*b* may support the kernel container 104. The base 406*b* in conjunction with the kernel container 104 may increase the stability of the separating apparatus 100 when the separating apparatus 100 is set down on a table. For example, the base 406*b* may have a diameter that is wider than the diameter of the kernel container 104. Further, the base 406*b* and the kernel container 104 may jointly function as a stand for the popped corn container 102 when the popped corn container 102 is used as a serving bowl. The base 406*b*, kernel container 104, and popped corn container 102 may include a decorative pattern that increases the aesthetic presence of the separating apparatus 100 during the serving of the popcorn. For example, the separating apparatus 100 may include the insignia of favorite athletic teams, decorative flowers and designs, etc. In a further embodiment, the base 406*b* may be detachable to facilitate the emptying of the kernels from the kernel container 104.

In at least one embodiment, the kernel restraining structure 108 may be integrated into the kernel container 104. For example, the integrated kernel restraining structure 410 may be a funnel like structure built into the kernel container 104. The integrated kernel restraining structure 410 may funnel the kernels that pass through the kernel separator 106 into the bottom of the kernel container 104, impeding the kernels that passed through the funnel from coming into contact with the kernel separator 106.

Figure 5A:
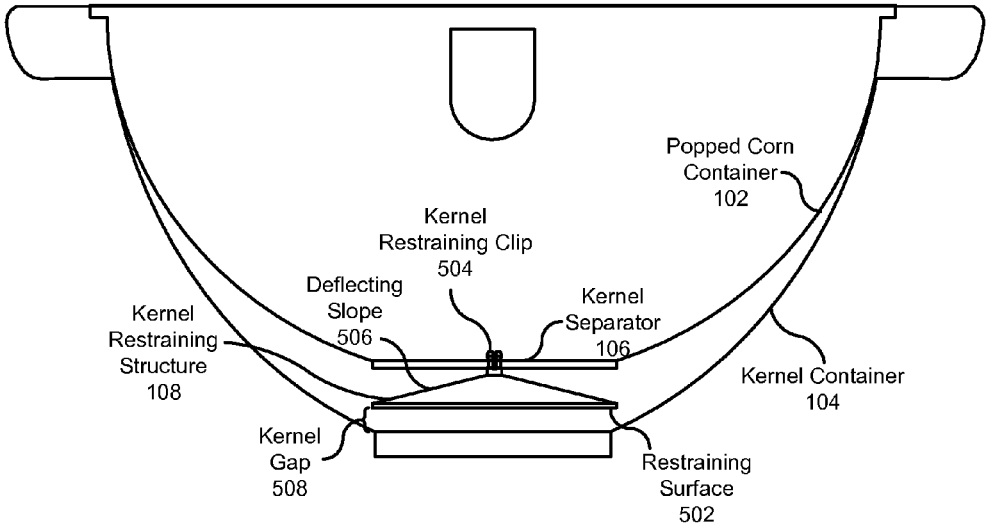
FIG. 5A is a side view of a popped corn container nested in a kernel container with an attached kernel restraining structure in accordance with the present invention.

FIG. 5A shows a cross sectional view of the popped corn container 102 nested within the kernel container 104 with the kernel restraining structure 108 attached to the popped corn container 102 according to at least one embodiment. The kernel restraining structure 108 may include a restraining surface 502, a kernel restraining clip 504, a deflective slope 506, and a kernel gap 508. The kernel restraining structure 108 acts as a further impediment in preventing kernels from reentering the popped corn container 102 in FIG. 1 and may be located between the kernel separator 106 and the bottom of the kernel container 104. Further, the kernel restraining structure 108 may cover an area that is greater than or equal to the area of the base 406*a* in FIG. 4A and the area of the kernel separator 106. As kernels pass through the kernel separator 106, the deflective slope 506 deflects the kernels away from the kernel separator 106. The kernels then slide under the restraining surface 502 which further prevents kernels from reentering the popped corn container 102.

In certain embodiments, the shape of the kernel restraining structure 108 may impede a kernel from reentering the popped corn container 102 through the kernel separator 106. For example, the kernel restraining structure 108 may have a circumference that matches or exceeds the circumference of the kernel separator 106. Further, a space larger than a kernel may exist between the kernel separator 106 and the kernel restraining structure 108. Also, the surface of the kernel restraining structure 108 that is closest to the kernel separator 106 may slope away from the kernel separator 106. For example, the kernel restraining structure 108 may be shaped like a conical bell or an umbrella. The top point of the umbrella shaped kernel restraining structure 108 may face the kernel separator 106 and the kernel restraining structure 108 may slope away from the top point in all directions. As the kernel passes through the kernel separator 106, the kernel may come into contact with the top surface of the umbrella shaped kernel restraining structure 108. The slope of the kernel restraining structure 108 may direct the kernels away from the kernel separator 106 towards the sides of the kernel container 104. The sides of the kernel container 104 then may slope toward the base of the kernel container 104.

In at least one embodiment, the kernel restraining structure 108 may attach to the kernel separator 106. The kernel restraining structure 108 may attach to the kernel separator 106 via the kernel restraining clip 504. The kernel restraining clip 504 is pushed through the kernel retention catch 304 in FIG. 3A, such that the kernel restraining clip 504 secures the kernel restraining structure 108 to the kernel separator 106. By attaching the kernel restraining structure 108 to the kernel separator 106, the kernel restraining structure 108 may create a kernel gap 508 between the restraining surface 502 of the kernel restraining structure 108 and the base of the kernel container 104. The kernel gap 508 may allow kernels to slide underneath the kernel restraining structure 108 when the sides of the kernel container 104 direct the kernels towards the base of the kernel container 104. During agitation of the separating apparatus 100, a kernel that is under the kernel restraining structure 108 may deflect off of the restraining surface 502, maintaining the kernel under the kernel restraining structure 108.

Figure 5B:
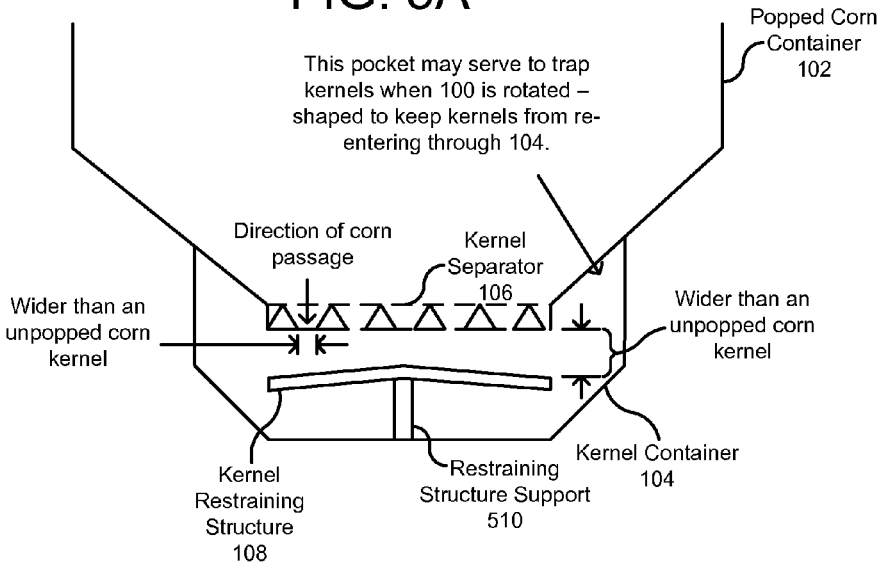
FIG. 5B is a cross sectional view of a kernel restraining structure in accordance with the present invention.

FIG. 5B shows a cross sectional view of the kernel restraining structure 108 attached to the kernel container 104 according to at least one embodiment. In at least one embodiment, the kernel restraining structure 108 may attach to the kernel container 104. The kernel restraining structure 108 may include a restraining structure support 510 that attaches the kernel restraining structure 108 to the kernel container 104. The restraining structure support 510 may support the kernel restraining structure 108 such that there is space for kernels to pass between the kernel restraining structure 108 and the kernel separator 106. Further, the restraining structure support 510 may elevate the kernel restraining structure 108 away from the base 406*a* in FIG. 4A of the kernel container 104, such that a kernel may pass under the kernel restraining structure 108. For example, when the restraining structure support 510 elevates the kernel restraining structure 108 away from the base 406*a*, the kernel restraining structure 108 may have space between the bottom of the kernel restraining structure 108 and the base 406*a* such that a kernel could pass under the kernel restraining structure 108.

In a further embodiment, the kernel container 104 may have space along the sides of the kernel container 104 to store kernels when the separating apparatus 100 is rotated or tipped over to further impede kernels from passing through the kernel separator 106 into the popped corn container 102.

Figure 5C:
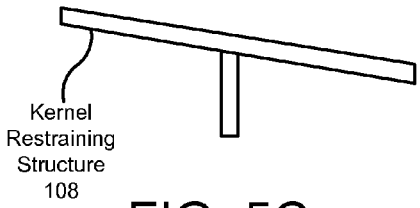
FIG. 5C is a cross sectional view of a kernel restraining structure in accordance with the present invention.

FIG. 5C shows a kernel restraining structure 108 according to at least one embodiment. The kernel restraining structure 108 may include a shape or device that impedes kernels from contacting the kernel separator 106. For example, the kernel restraining structure 108 in FIG. 5C may be an inclined plane that slopes away from the kernel separator 106. In another embodiment, the kernel separator 106 may include a gasket, a unidirectional valve, a funnel, an adhesive, a trapdoor, and the like. In at least one embodiment, the kernel restraining structure 108 may be permanently affixed to the popped corn container 102. Alternatively, the kernel restraining structure 108 may be permanently affixed to the kernel container 104. Further, the kernel restraining structure 108 may detach from the separating apparatus 100. The restraining structure support 510 may be connected to the bottom, side, etc. of the kernel container 104.

In certain embodiments, the kernel restraining structure 108 may be constructed of a rigid material. For example, the kernel restraining structure 108 may be constructed of plastic, metal, glass, and the like. Alternatively, the kernel restraining structure 108 may be constructed of a flexible material. For instance, the kernel restraining structure 108 may be constructed of rubber, disposable cardboard, flexible plastic, and the like. For example, the kernel restraining structure 108 may be rubber connected to the kernel separator 106 that flexes away from the kernel separator 106 under the weight of one or more kernels or due to agitation forces and may swing up to kernel separator 106 when not agitated, when a kernel is not against a top of the flexible material, etc. In this embodiment, the kernel restraining structure 108 may act as a flapper valve. The kernel restraining structure 108 may impede kernels in the kernel container 104 from contacting the kernel separator 106.

In one embodiment, the kernel separator 106 is connected to the popped corn container 102. In another embodiment, the kernel separator 106 connects to the kernel container 104. In other embodiments, the kernel separator 106 is permanently connected or is formed with either the popped corn container 102 or kernel container 104. In other embodiments, the kernel separator 106 is may be disconnected from the popped corn container 102 or kernel container 104.

The kernel separator 106 may be sized for various types of popcorn. In one embodiment, the separating apparatus 100 is provided with a number of kernel separators 106. For example, one kernel separator 106 may be sized for typical popcorn while another kernel separator 106 may be sized for smaller kernels. In other embodiments, other screens or strainers may be supplied with the separating apparatus 100 for other purposes. For example, a strainer may be supplied and connected to the popped corn container 102 and may be suitable for straining water from vegetables or pasta. One of skill in the art will recognize other screens or strainers that may be supplied with the separating apparatus 100 for other purposes and other kernel separators 106 for popcorn.

Figure 6:
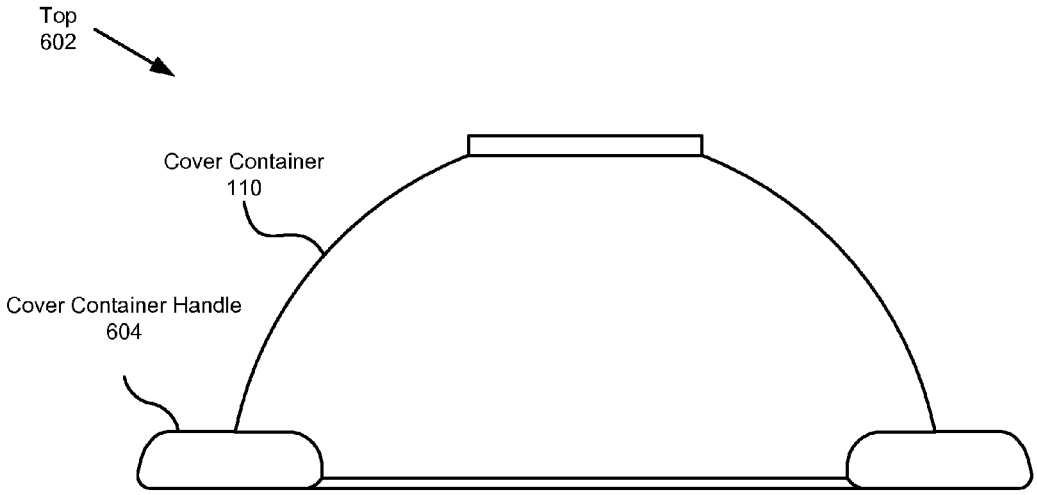
FIG. 6 is a side view of a cover container in accordance with the present invention.

FIG. 6 shows a side view of the cover container 110. In certain embodiments, the cover container 110 is substantially similar to the kernel container 104 in FIG. 4A. The cover container 110 may include a cover container handle 604 and a top 602. In at least one embodiment, the cover container 110 may include cover container handles 604 that interlock with the kernel container handles 404 in FIG. 4A of the kernel container 104. By interlocking, the cover container handles 604 and the kernel container handles 404 may secure the separating apparatus 100 in FIG. 1 and enclose the popcorn within the separating apparatus 100 during shaking allowing a user to shake the separating apparatus 100 with as much intensity as desired. The cover container handles 604 and the kernel container handles 404 may allow a user to securely grasp both the cover container 110 and the kernel container 104 simultaneously.

In another embodiment, the top 602 may include a cooking surface, such that popcorn can be popped in the popped corn container 102 or in a cover container 110. Where the cooking surface is the top 602 and attaches to the popped corn container 102, the kernel separator 106 may serve as a vent. The top 602 may include a heat conductive surface that allows a heat source or energy source to pop the popcorn. In one example, the top 602 may be constructed of a ferromagnetic material or other material that can be placed directly on a stove burner or heated through an inductive cooker. In another embodiment, the top 602 may include a screen that allows hot air to move through the top 602 but keeps popcorn in the popped corn container 102 or cover container 110, popping the popcorn with hot air. Further, the cover container 110 may be microwave safe, such that a microwave oven can pop the popcorn. By popping popcorn in the popped corn container 102 or cover container 110, the separating apparatus 100 in FIG. 1 can be used to pop, prepare, and present the popcorn.

In one embodiment, a user can place popcorn in the cover container 110 with other materials needed to pop the popcorn. The separating apparatus 100 can be assembled and then the popcorn can be popped in the popped corn container 102 or the cover container 110. After the popcorn finishes cooking, flavoring can be added into the separating apparatus 100. After the flavoring is added, the separating apparatus 100 may be assembled again. After the separating apparatus 100 is assembled, a user can shake the separating apparatus 100 to spread the flavor and remove the kernels in one step. After the kernels are removed, a user can put the popped corn back into the cover container 110 where the cover container 110 may function as a serving bowl. A user may then dispose of the kernels in the kernel container 104. In conjunction with covering the popped corn container during kernel removal, the cover container 110 also functions as a popping apparatus and a serving bowl.

In another embodiment, the separating apparatus 100 is first used to separate un-popped kernels from popped corn. The popped corn may then be placed in the cover container 110 and the popped corn container 102 may be separated from the kernel container 104 to removed un-popped kernels. Next, flavoring may be added to the popped corn in the cover container 110 and the kernel container 104 may be connected to the cover container 110 and the cover container 110 and the kernel container 104 may be shaken to spread the flavoring throughout the popped corn. In another embodiment, the cover container 110 and the kernel container 104 interlock to keep the cover container 110 and the kernel container 104 together during shaking. The interlocking mechanism (not shown) may be a friction lock, a sliding lock, a clip, or any other locking mechanism known in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for separating popped corn from un-popped kernels, the apparatus comprising:

a popped corn container that holds popped corn and a kernel separator located on a side of the popped corn container, the kernel separator comprising:

a kernel separator screen comprising a plurality of holes, wherein a hole in the plurality of holes is larger than an un-popped kernel and smaller than a fully popped corn; and a reentry impedance means for impeding an un-popped kernel from entering the popped corn container through the kernel separator, the reentry impedance means comprising lateral cross members that bound each hole in the plurality of holes in the kernel separator screen, wherein the lateral cross members have a triangular cross section, a base of the triangular cross section on a kernel face of the kernel separator, the kernel face facing exterior to the popped corn container, and a vertex of the triangular cross section on a popped corn face of the kernel separator, the popped corn face facing interior to the popped corn container; and a kernel container positioned outside the popped corn container and adjacent to the kernel separator such that the kernel container stores the un-popped kernel after the un-popped kernel has passed through the kernel separator.

2. The apparatus of claim 1, wherein the sides of the popped corn container slope toward the kernel separator.

3. The apparatus of claim 1, wherein the popped corn container comprises a bowl and the kernel separator is located at the bottom of the bowl.

4. The apparatus of claim 1, wherein each hole in the plurality of holes comprises an opening on the popped corn face that is larger than an opening on the kernel face.

5. The apparatus of claim 4, wherein the opening on the popped corn face is smaller than a fully popped corn and the opening on the kernel face is larger than an un-popped kernel.

6. The apparatus of claim 1, wherein the lateral cross members are oriented substantially perpendicularly to one another.

7. The apparatus of claim 1, wherein the reentry impedance means comprises a kernel retention means for maintaining the kernels in the kernel container.

8. The apparatus of claim 7, wherein the kernel retention means comprises a kernel restraining structure positioned between the kernel separator screen and a bottom of the kernel container such that kernels at the bottom of the kernel container are impeded from re-entry into the popped corn container when agitated, the kernel restraining structure positioned such that a space between the kernel separator screen and the kernel restraining structure is wider than a kernel.

9. The apparatus of claim 8, wherein the kernel restraining structure is positioned to slope away from the kernel separator screen.

10. The apparatus of claim 9, wherein the kernel restraining structure comprises an umbrella shape, such that a top point of the kernel restraining structure faces the kernel separator screen and the kernel restraining structure slopes away from the top point in all directions.

11. The apparatus of claim 8, wherein the sides of the kernel container slope towards a bottom of the kernel container, the bottom of the kernel container comprising an area that matches or is less than an area of the kernel restraining structure.

12. The apparatus of claim 8, wherein the kernel restraining structure has an area that matches or exceeds an area of the kernel separator screen.

13. The apparatus of claim 1, wherein the kernel container comprises a bowl, the popped corn container nesting inside the kernel container.

14. The apparatus of claim 13, wherein the popped corn container further comprises a gripable area for removing the popped corn container from inside of the kernel container.

15. The apparatus of claim 1, further comprising a graspable handle attached to the kernel container.

16. The apparatus of claim 1, wherein the kernel container interlocks with the popped corn container.

17. The apparatus of claim 1, further comprising a cover container.

18. An apparatus for separating popped corn from un-popped kernels, the apparatus comprising:

a popped corn container that holds popped corn and a kernel separator located on a side of the popped corn container, the kernel separator comprising a kernel separator screen comprising a plurality of holes, wherein a hole in the plurality of holes is larger than an un-popped kernel and smaller than a fully popped corn, wherein the hole is bounded by lateral cross members having a triangular cross section, a base of the triangular cross section on a kernel face of the kernel separator, the kernel face facing exterior to the popped corn container, and a vertex of the triangular cross section on a popped corn face of the kernel separator, the popped corn face facing interior to the popped corn container;

a kernel container positioned outside the popped corn container and adjacent to the kernel separator such that the kernel container stores the un-popped kernel after the un-popped kernel has passed through the kernel separator;

a kernel restraining structure positioned between the kernel separator screen and a bottom of the kernel container, the kernel restraining structure comprising an umbrella shape, such that a top point of the kernel restraining structure faces the kernel separator screen and the kernel restraining structure slopes away from the top point in all directions; and a cover container that rests above the popped corn container.

19. An apparatus for separating popped corn from un-popped kernels, the apparatus comprising:

a popped corn container that holds popped corn and a kernel separator located on a side of the popped corn container, the kernel separator comprising:

a kernel separator screen comprising a plurality of holes, wherein a hole in the plurality of holes is larger than an un-popped kernel and smaller than a fully popped corn, wherein the hole is bounded by lateral cross members having a triangular cross section, a base of the triangular cross section on a kernel face of the kernel separator, the kernel face facing exterior to the popped corn container, and a vertex of the triangular cross section on a popped corn face of the kernel separator, the popped corn face facing interior to the popped corn container; and a kernel restraining structure positioned between the kernel separator screen and a bottom of the kernel container such that kernels at the bottom of the kernel container are impeded from re-entry into the popped corn container when agitated;

a kernel container positioned outside the popped corn container and adjacent to the kernel separator such that the kernel container stores the un-popped kernel after the un-popped kernel has passed through the kernel separator and a cover container comprising a popcorn cooking surface.

* * * * *